US009500089B2

(12) United States Patent
Edwards

(10) Patent No.: US 9,500,089 B2
(45) Date of Patent: Nov. 22, 2016

(54) ROTARY ENERGY GENERATING SYSTEM AND CORRESPONDING DEVICE

(71) Applicant: Louie Edwards, Sanford, FL (US)

(72) Inventor: Louie Edwards, Sanford, FL (US)

( * ) Notice: Subject to any disclaimer, the term of this patent is extended or adjusted under 35 U.S.C. 154(b) by 944 days.

(21) Appl. No.: 13/681,532

(22) Filed: Nov. 20, 2012

(65) Prior Publication Data

US 2013/0142635 A1 Jun. 6, 2013

Related U.S. Application Data

(60) Provisional application No. 61/562,553, filed on Nov. 22, 2011.

(51) Int. Cl.

| | |
|---|---|
| ***F01D 5/30*** | (2006.01) |
| ***F01D 1/02*** | (2006.01) |
| ***F01D 7/00*** | (2006.01) |
| ***F01C 1/06*** | (2006.01) |
| ***F01C 21/08*** | (2006.01) |

(52) U.S. Cl.

CPC . *F01D 5/30* (2013.01); *F01C 1/06* (2013.01); *F01C 21/089* (2013.01); *F01C 21/0836* (2013.01); *F01D 1/026* (2013.01); *F01D 7/00* (2013.01); *F04C 2210/227* (2013.01); *F05D 2220/31* (2013.01)

(58) Field of Classification Search

CPC ..... F01D 1/023; F01D 1/026; F01D 5/30; F01D 7/00; F01D 23/00; F01D 25/34; F04D 5/00; F04D 11/00; F04D 11/005; F04D 23/00; F04D 29/225; F04D 29/247; F01C 1/06; F01C 21/0836; F01C 21/089; F04C 2210/227; F05D 2220/31; F03B 1/02; F03B 3/14; F03B 3/145; F03B 7/00

USPC ..... 415/8, 125, 129, 130, 140, 141, 224; 416/108–109, 110, 112–114, 116

See application file for complete search history.

(56) References Cited

U.S. PATENT DOCUMENTS

| | | | | |
|---|---|---|---|---|
| 3,877,677 A | | 4/1975 | Daghe | |
| 4,007,910 A | * | 2/1977 | Yasuoka | F16K 1/221 251/229 |
| 4,115,045 A | | 9/1978 | Wyman | |

(Continued)

OTHER PUBLICATIONS

Armstron, W.G. "On Hydraulic Power—New Hydraulic Machine" Machanic's Magazine; Dec. 29, 1838, No. 803.

*Primary Examiner* — Craig Kim
*Assistant Examiner* — Alexander White
(74) *Attorney, Agent, or Firm* — Allen, Dyer, Doppelt, Milbrath & Gilchrist, P.A.

(57) ABSTRACT

A rotary energy generating device includes an output shaft, a rotor coupled to the output shaft, and a plurality of paddles coupled to the rotor, with each paddle being moved between vertical and horizontal positions as the rotor is rotated. A chamber housing includes inlet and output pairs. A respective open chamber area is defined between each inlet and outlet pair based on a given rotation direction of the rotor, with each respective open chamber area configured to receive the paddles in the vertical position as the rotor rotates in the given rotation direction. A respective slotted chamber area is defined between each outlet and inlet pair based on the given rotation direction of the rotor, with each respective slotted chamber area configured to receive the paddles in the horizontal position as the rotor rotates in the given rotation direction.

19 Claims, 12 Drawing Sheets

(56) References Cited

U.S. PATENT DOCUMENTS 4,186,313 A * 1/1980 Wurtz ..... F03D 3/062 290/44
4,451,219 A 5/1984 Kurherr
4,968,217 A * 11/1990 Newton ..... B64C 11/32 416/147
6,543,999 B1 * 4/2003 Polen ..... F03D 3/067 416/116
6,793,194 B1 9/2004 Grinberg
2010/0028126 A1 2/2010 Sheldon et al.
2010/0215484 A1 8/2010 Mahawili
2014/0037450 A1 * 2/2014 Amirian ..... F03B 3/10 416/117

* cited by examiner

ROTARY ENERGY GENERATING SYSTEM AND CORRESPONDING DEVICE

RELATED APPLICATIONS

This application claims the benefit of U.S. Provisional Application Ser. No. 61/562,553 filed Nov. 22, 2011, the entire contents of which are incorporated herein by reference.

FIELD OF THE INVENTION

The present invention relates to the field of energy generating systems, and more particularly, to a rotary energy generating system.

BACKGROUND OF THE INVENTION

There are a variety of energy generating systems, including those operating with steam turbines, for example. Large scale steam turbines produce electricity but at a relatively low efficiency rate.

Smaller scale turbines can operate with greater efficiency. For example, U.S. published patent application no. 2010/0215484 discloses a turbine comprising a housing, a shaft rotatably supported in the housing about an axis of rotation, and a wheel with a plurality of turbine blades supported in a chamber by the shaft for rotation with the shaft. High pressure gas, such as steam, is directed into the housing through an inlet so that the gas impinges the blades to induce rotation of the wheel about the shaft.

Another type of energy generating system is one operating with a rotary steam engine, as disclosed in U.S. Pat. No. 4,115,045. This rotary steam engine includes a circular casing with side walls defining an interior cylindrical section wherein a rotor rotates therein. The rotor includes a hub, radial spokes, and a circular rim. Extending from an outer periphery of the rim is a series of spaced transverse lobes extending from side wall to side wall within the casing. The casing includes a series of spaced spring-biased transverse vanes to engage the outer periphery, seals and lobes of the rotor. A series of chambers are defined by the seals and lobes, outer periphery of the rotor, the inner periphery of the casing and the side walls. A series of steam inlet and exhaust steam outlet pairs communicate with the chambers as the rotor is rotated by expansion of live steam against the vanes in the chambers.

Even in view of known energy generating systems that are an alternative to those operating with large scale steam turbines, there is still a need to provide other configurations of energy generating systems that are efficient and straightforward to operate.

SUMMARY OF THE INVENTION

In view of the foregoing background, it is therefore an object of the present invention to provide a rotary energy generating device that is efficient and straightforward to operate.

This and other objects, features, and advantages in accordance with the present invention are provided by a rotary energy generating device comprising an output shaft, a rotor coupled to the output shaft, and a plurality of paddles coupled to the rotor, with each paddle being moved between vertical and horizontal positions as the rotor is rotated.

A chamber housing may include a plurality of inlet and output pairs. A respective open chamber area may be defined between each inlet and outlet pair based on a given rotation direction of the rotor, with each respective open chamber area configured to receive the plurality of paddles in the vertical position as the rotor rotates in the given rotation direction. A respective slotted chamber area may be defined between each outlet and inlet pair based on the given rotation direction of the rotor, with each respective slotted chamber area configured to receive the plurality of paddles in the horizontal position as the rotor rotates in the given rotation direction.

Each inlet may be configured to receive a pressurized fluid, such as steam or gas, for example, to push a paddle through a respective open chamber area. Each outlet may be configured to exhaust the pressurized fluid after the paddle has been pushed through a respective slotted chamber area.

A plurality of lifters may be carried by the rotor, with each paddle having a lifter coupled thereto. A plurality of backstops may be carried by the rotor, with each lifter having a respective backstop associated therewith.

In one embodiment, each lifer may comprise a threaded section, and each paddle may comprise a handle extending outwards therefrom, with the handle comprising a threaded section for engaging the threaded section of a respective lifter.

In another embodiment, each lifer may include a recessed pocket, and a roller bearing assembly that moves up and down in the recessed pocket. Each paddle may comprise a handle extending outwards therefrom, and a lever coupled between the handle and the roller bearing assembly of each lifter.

Each lifter may comprises an upper bearing carried by an upper end thereof, and a lower bearing carried by an opposing lower end thereof. The rotary energy generating device may further include a fixed upper guide rail contacting the upper guide bearings of the plurality of lifters, and a fixed lower guide rail contacting the lower guide bearings of the plurality of lifters. The fixed upper and lower guide rails may be configured to guide the plurality of lifers for moving the paddles between the vertical and horizontal positions as the rotor is rotated.

The fixed upper and lower guide rails may be coupled to the chamber housing. Each paddle may be circular shaped, and each respective open chamber area may also be circular.

Another aspect of the present invention is to provide a rotary energy generating system comprising a steam generator, a rotary energy generating device coupled to the steam generator, and an electrical generator coupled to the output shaft of the rotary energy generating device. The rotary energy generating device may be configured as described above.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notations are used to indicate similar elements in alternative embodiments.

Figure 1:
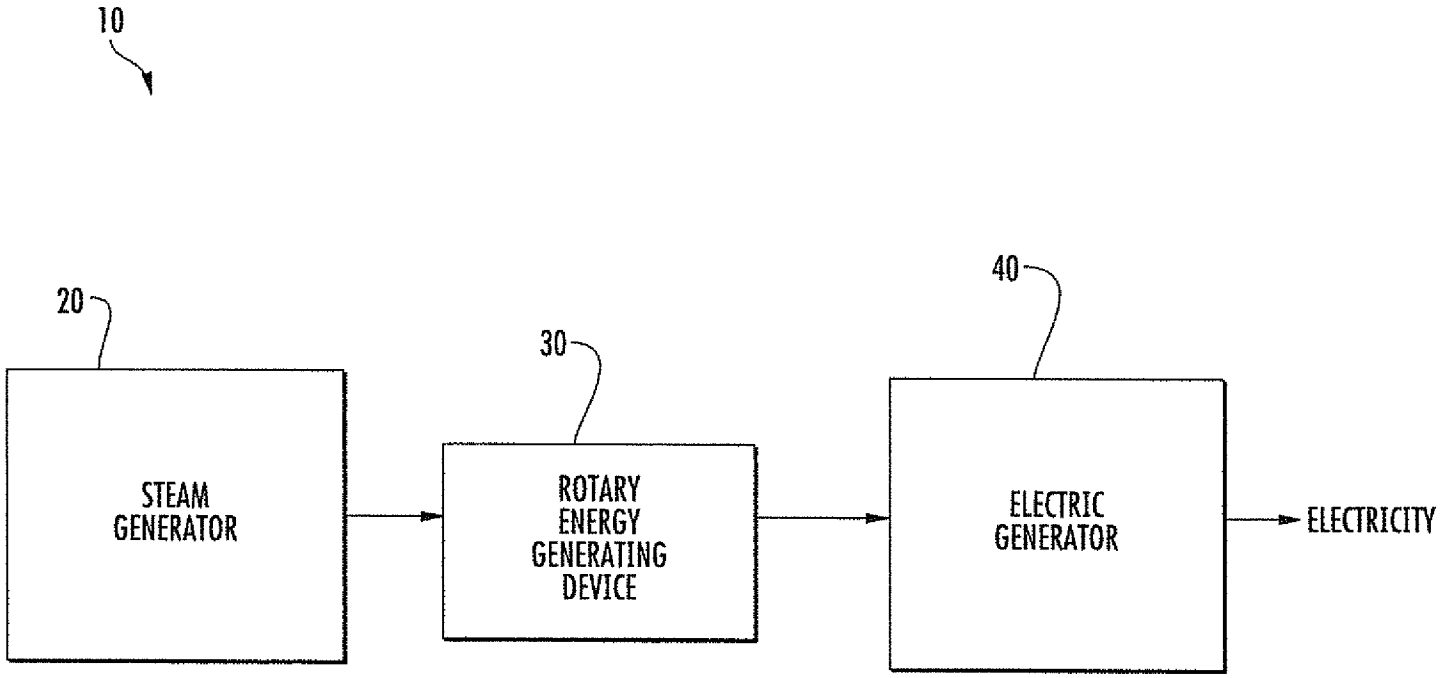
FIG. 1 is a block diagram of a rotary energy generating system in accordance with the present invention.
Figure 2:
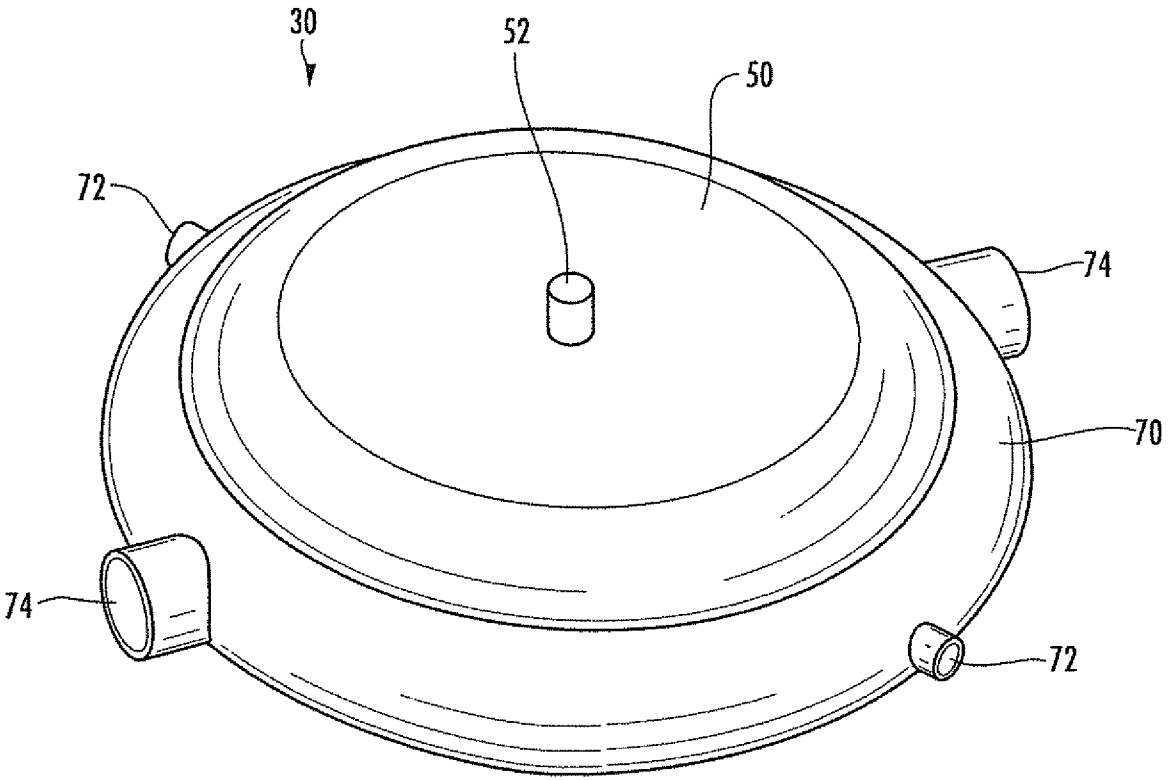
FIG. 2 is a perspective view of the rotary energy illustrated in FIG. 1.

Referring initially to FIGS. 1 and 2, a rotary energy generating system 10 includes a rotary energy generating device 30 coupled between a steam generator 20 and an electrical generator 40. The rotary energy generating device 30 may also be referred to as a rotary engine. For illustration purposes, the rotary energy generating device 30 is steam powered, and is used to operate the electrical generator 40 to generate electricity. The rotary energy generating device 30 includes a rotor section 50 and a chamber section 70 surrounding the rotor section.

As readily appreciated by those skilled in the art, alternatives to high pressure steam may be used to power the rotary engine 30, such as other types of high pressure fluids or gases. These fluids or gases may also be combustible. The rotary energy generating device 30 is not limited to operating an electrical generator, and may be used to operate other types of devices and machines.

The chamber section 70 is circular shaped and includes a pair of inlets 72 for receiving the steam from the steam generator 20, and a corresponding pair of outlets 74 for outputting the received steam. The received steam is used to turn a circular rotor within the rotor section 50 that is coupled to an output shaft 52 that interfaces with the electrical generator 40. The actual number of inlets 72 and outlets 74, as well as the size of the rotary engine 30, will vary based on the intended application.

Figure 3:
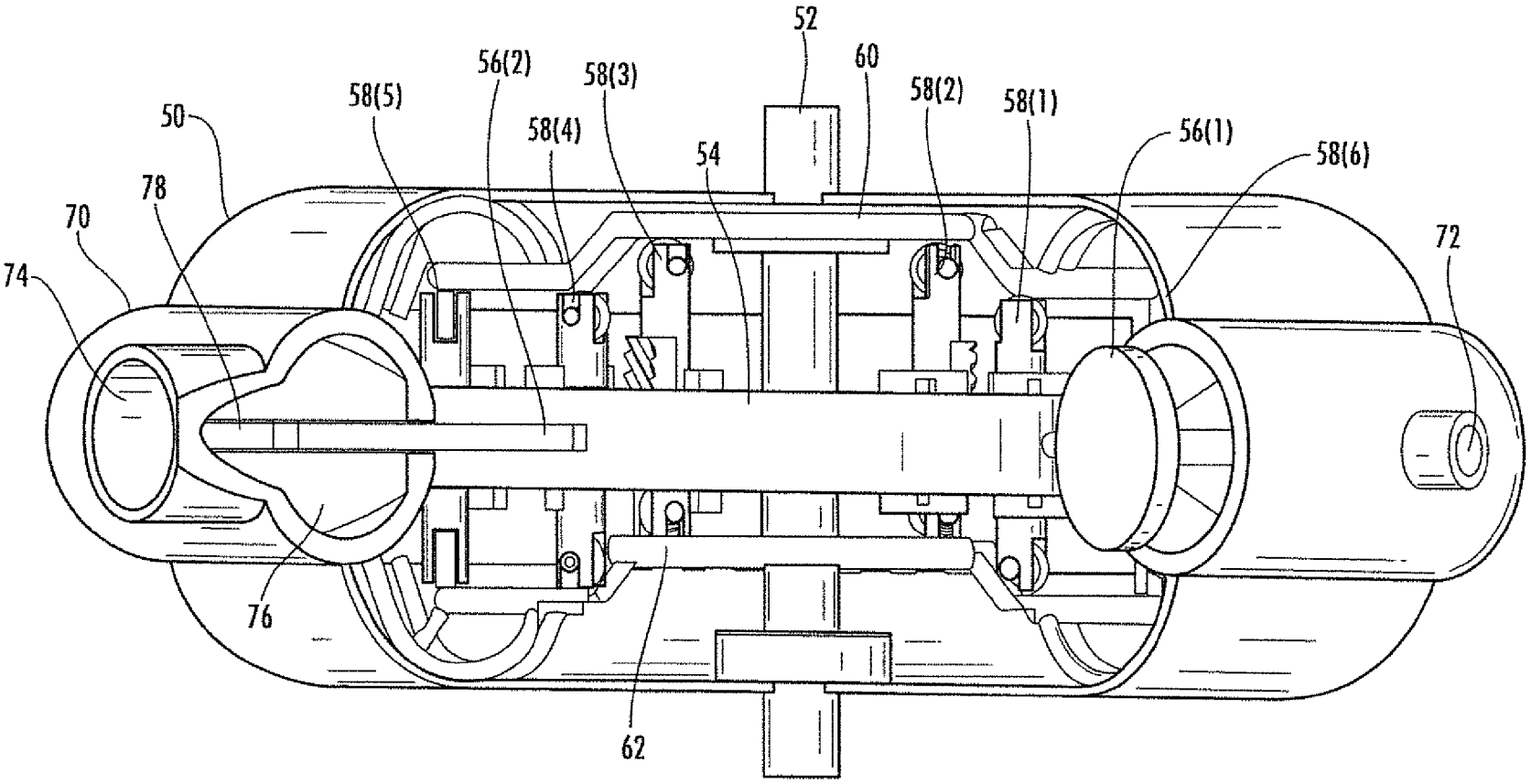
FIG. 3 is a partial cut-away view of the rotary engine in accordance with the present invention.

Referring now to a partial cut-away view of the rotary energy generating device 30, as provided in FIG. 3, the rotor and chamber sections 50, 70 will be generally discussed. The rotor section 50 includes a rotor assembly comprising a rotor 54, paddles 56(1)-56(6) rotatably coupled to the rotor, lifters 58(1)-58(6) carried by the rotor for causing the paddles to move between vertical and horizontal positions, and upper and lower guide rails 60, 62 for guiding the lifters as they rotate with the rotor. The upper and lower guide rails 60, 62 are stationary since they are attached to the chamber section or housing 70. The paddles 56(1)-56(6) will be generally indicated by reference 56. Similarly, the lifters 58(1)-58(6) will be generally indicated by reference 58.

The chamber section 70 includes two different chamber areas, open chamber areas 76 and slotted chamber areas 78. The two chamber areas are alternately positioned within the chamber section 70. As steam enters the inlets 72, a portion of the paddles 56 are pushed within the open chamber areas 76. The paddles 56 move between a vertical position when in the open chamber area 76, and a horizontal position when in the slotted chamber area 78. Movement of the paddles 56 is based on position of the lifters 58 traveling along the upper and lower rails 60, 62.

Figure 4:
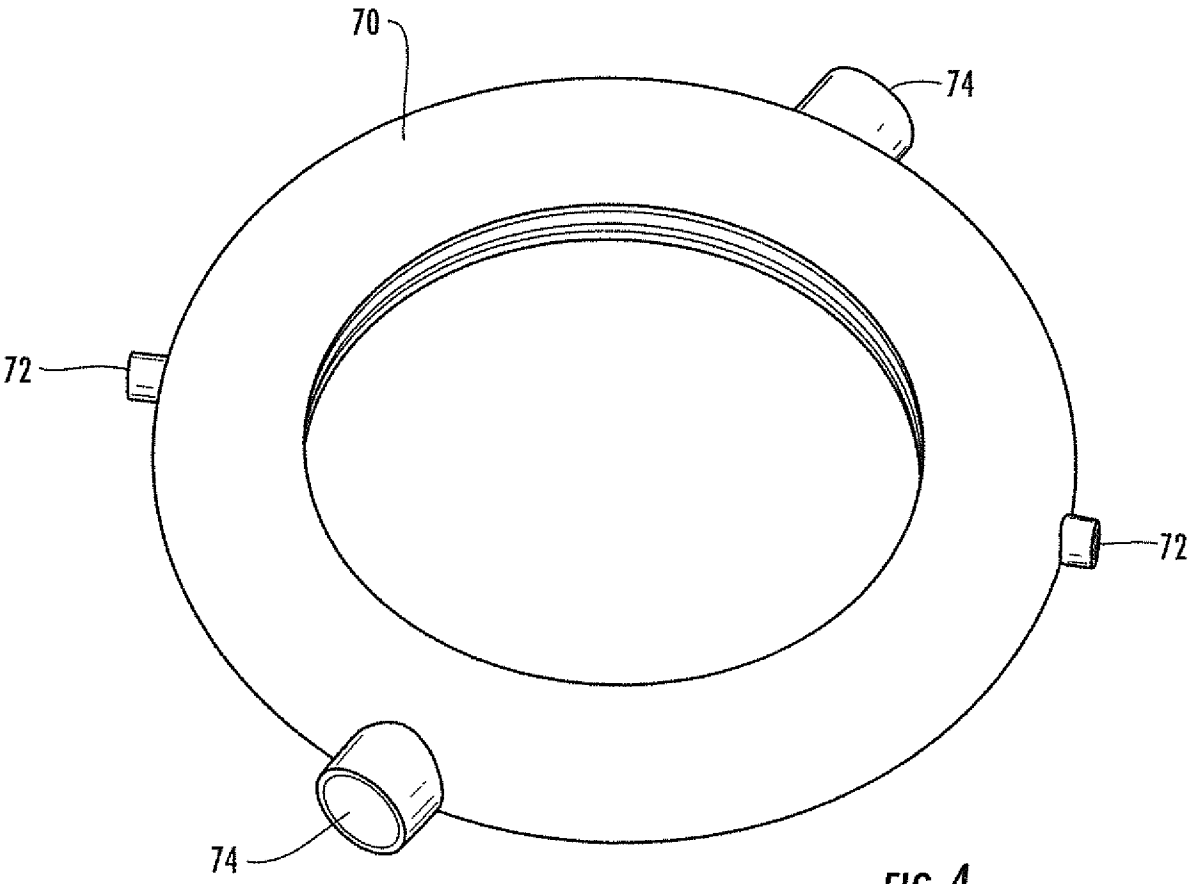
FIG. 4 is a perspective view of the chamber section of the rotary energy in accordance with the present invention.
Figure 5:
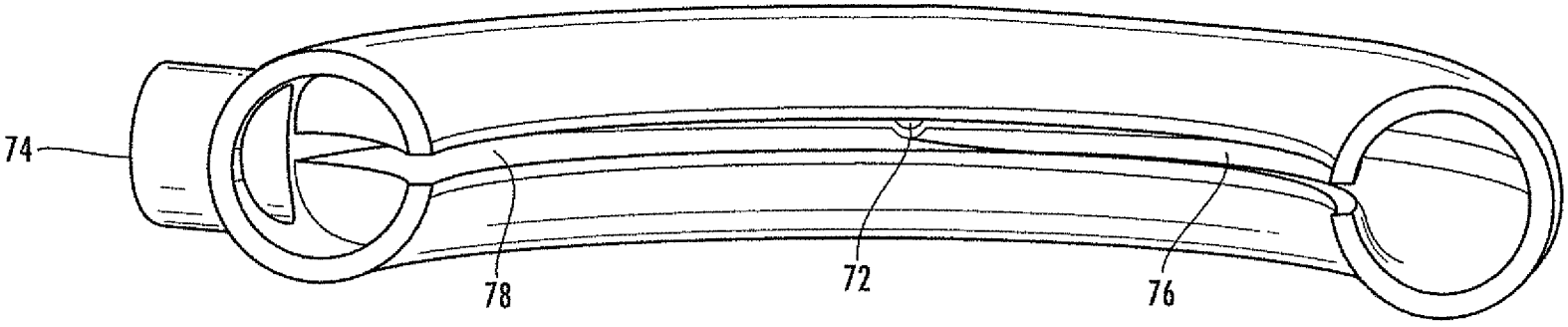
FIG. 5 is a partial cut-away view of the chamber section illustrated in FIG. 4.
Figure 6:
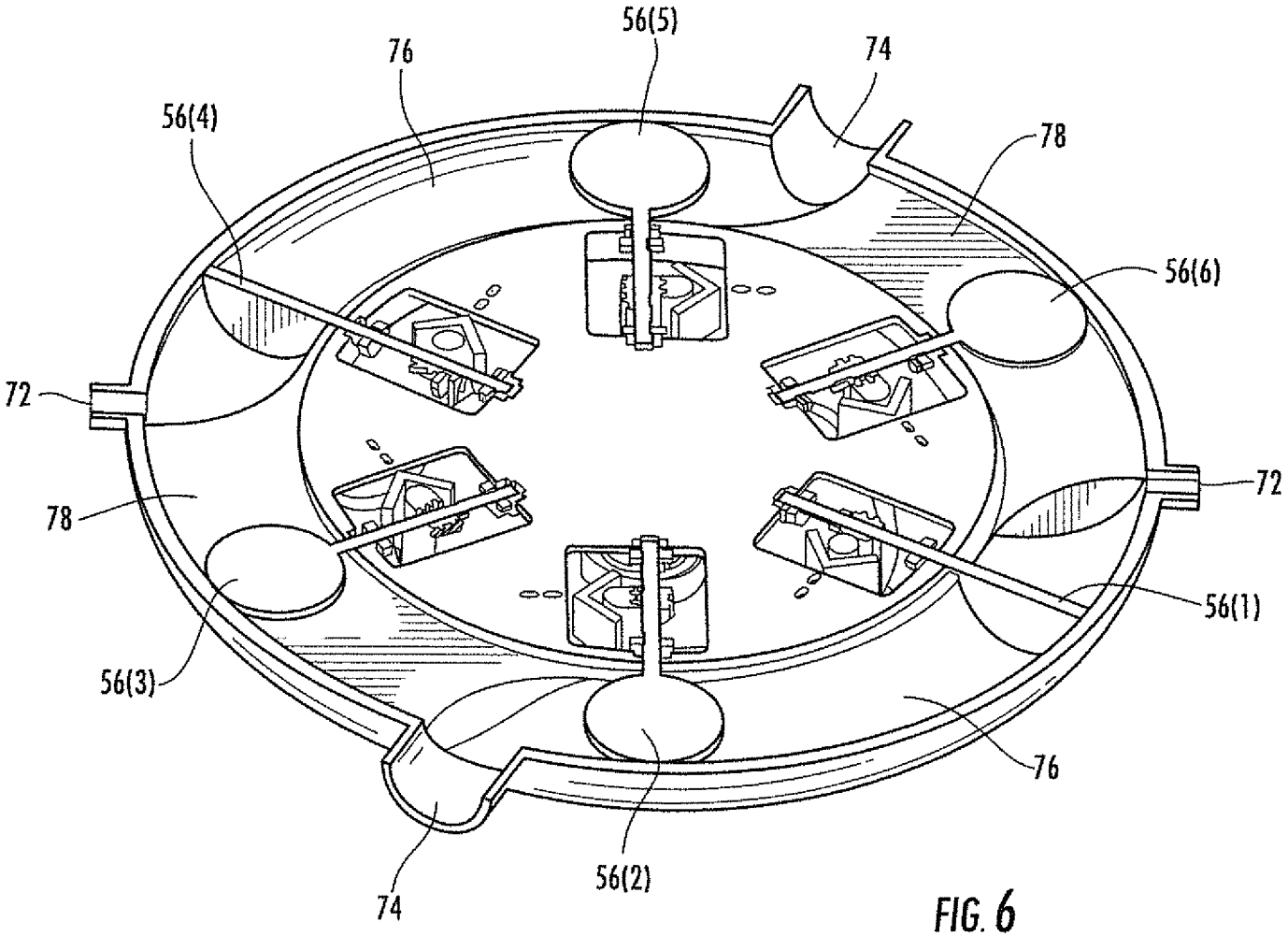
FIG. 6 is a perspective sectional view of a lower half of the chamber section of the rotary engine including a portion of the rotor section in accordance with the present invention.
Figure 7:
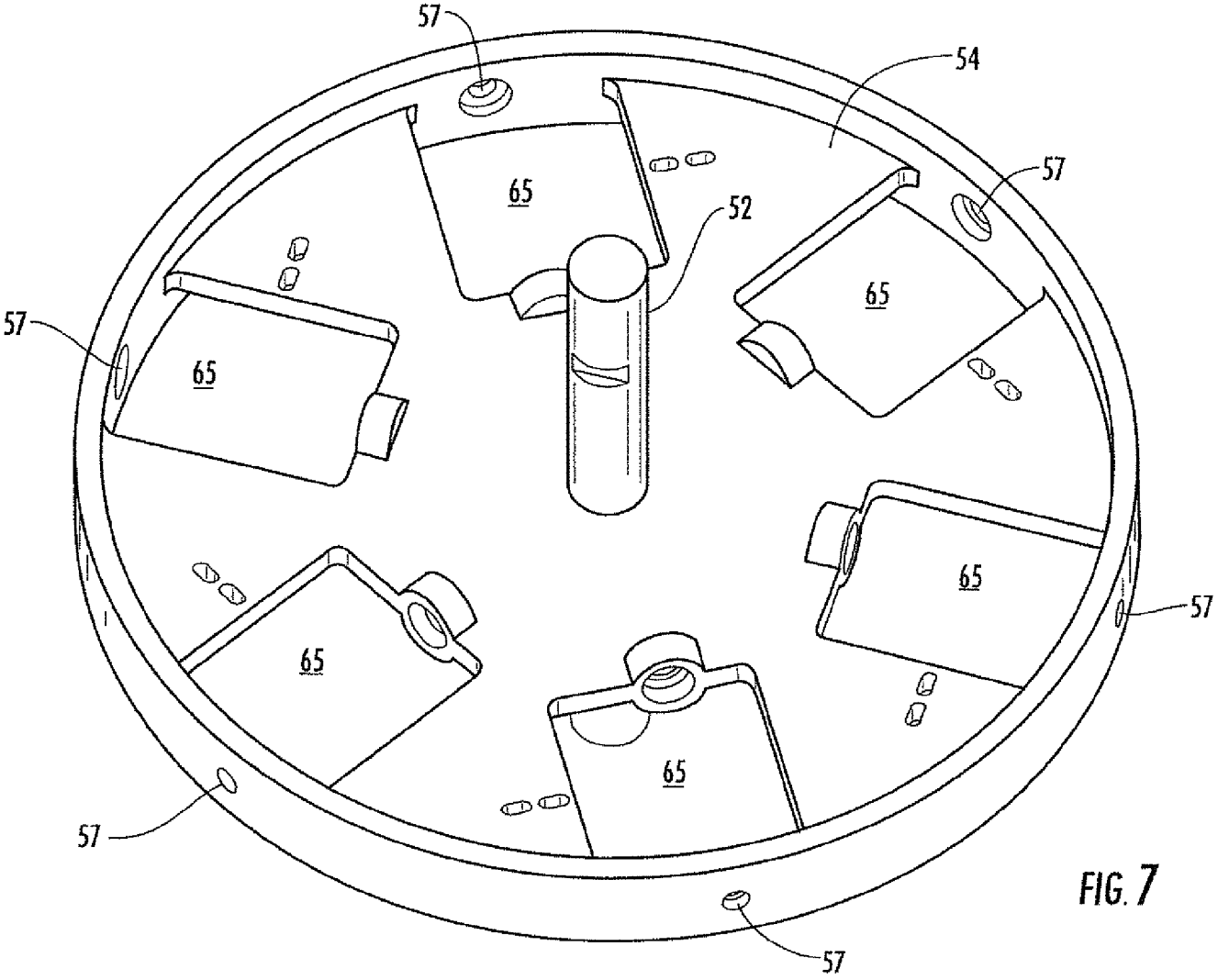
FIG. 7 is a perspective view of the rotor of the rotary energy in accordance with the present invention.
Figure 8:
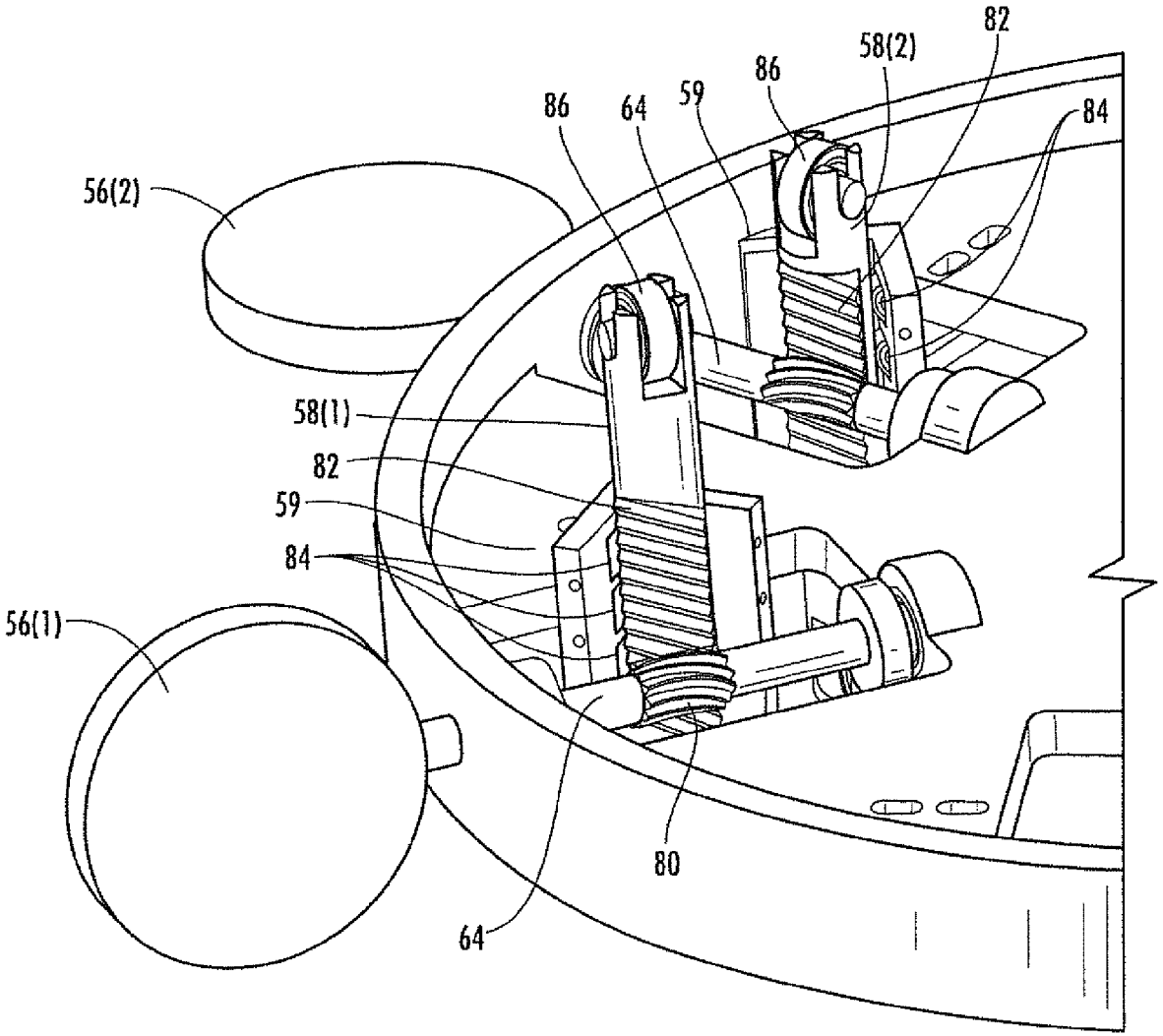
FIG. 8 is a perspective sectional view of the rotor of the rotary energy including the paddles and lifters in accordance with the present invention.
Figures 9A, 9B:
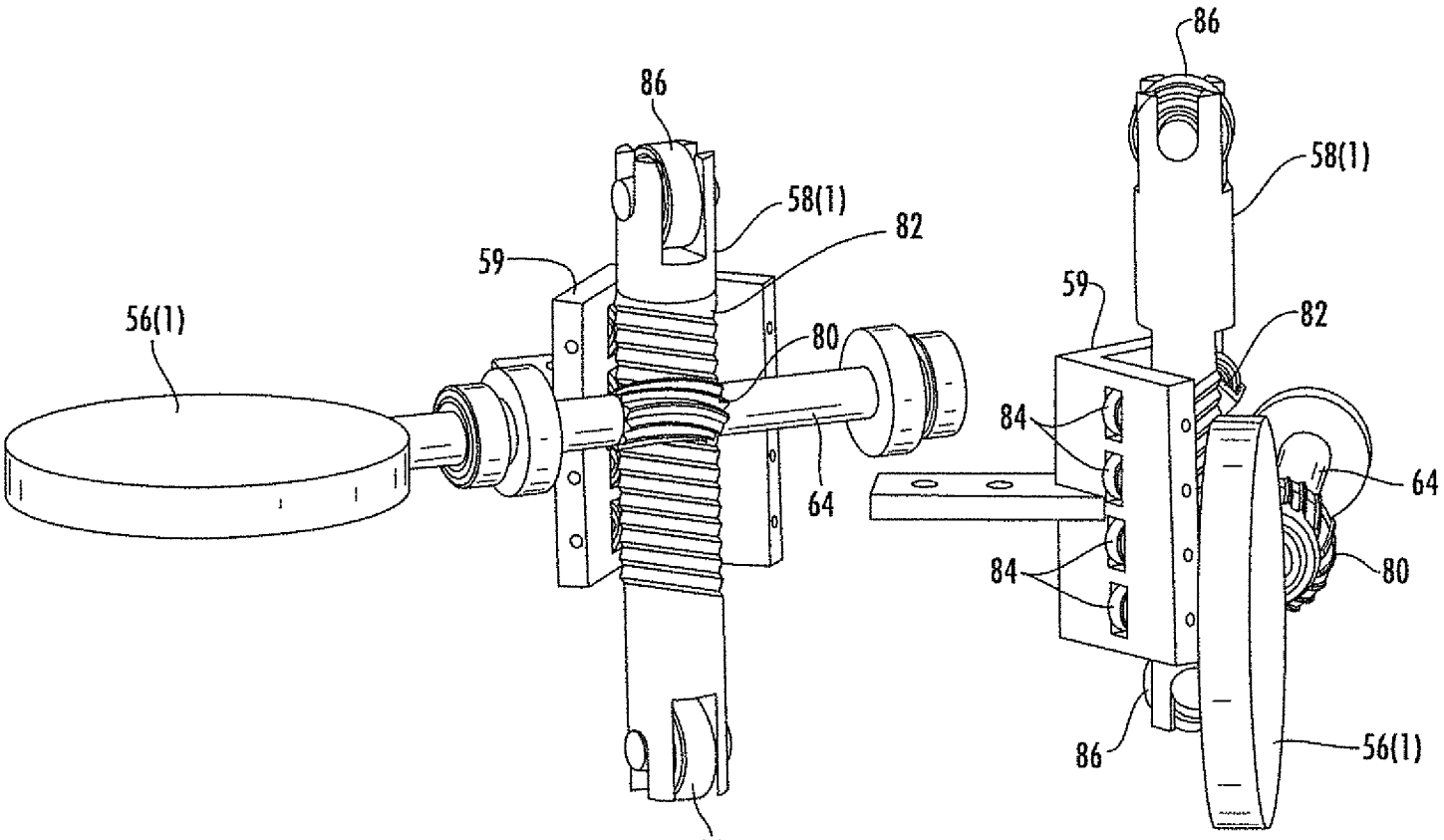
FIGS. 9*a* and 9*b* are side perspective views of a paddle and corresponding lifter illustrated in FIG. 8.

The chamber section 70 will now be discussed in greater detail in reference to FIGS. 4, 5 and 6. In the illustrated chamber section 70, there are two open chamber areas 76 and two slotted chamber areas 78. The actual number of open and slotted chamber areas 76, 78 will vary depending on the intended application.

The open chamber area 76 is defined between an inlet 72 and outlet 74 since this area receives the steam. The slotted chamber area 78 is also defined between an outlet 74 and an inlet 72, but does not receive any steam.

The paddles 56 move to the vertical position when in the open chamber area 76, as indicated by paddles 56(1) and 56(4). The open chamber area 76 has a circular shape to match the shape of the paddles 56. Although the illustrated paddles 56 are circular-shaped, other shapes are readily acceptable. A tight seal is created between the outer surfaces of each paddle 56 and the interior walls of the open chamber area 76 so as to make more efficient use of the steam.

As the paddles 56 approach the outlet 74, they are moved to the horizontal position so that they are able to rotate through the slotted chamber area 78, as indicated by paddles 56(2) and 56(5). The slot within the slotted chamber area 78 is sized to match or slightly exceed a thickness or width of the paddles 56. The function of the slotted chamber area 78 is to allow the steam to exit through the outlet 74, and to allow the paddles 56 to move to the next open chamber area 76, as indicated by paddles 56(3) and 56(6). As the paddles 56 enter the open chamber area 76, they are then moved by the lifters 58 from the horizontal position to the vertical position, as indicated by paddles 56(1) and 56(4). The beginning of the slot within the slotted chamber area 78 may be wedge-shaped or tapered so as to more easily receive the paddles 56 in the horizontal position.

The rotor section 50 will now be discussed in greater detail in reference to FIGS. 7, 8, 9*a*, 9*b* and 10. The rotor section 50 includes the rotor 54 that is configured to carry 6 paddles 56(1)-56(6). The actual number of paddles can vary based on the intended application, as readily appreciated by those skilled in the art. Each paddle 56 is to be inserted through a side opening 57 in the rotor 54. Each paddle 56 includes a handle 64 that extends through a respective side opening 57. Roller bearings are at the end of the handles 64 to assist with movement of the paddles 56. Likewise, roller bearings surround the handle 64 adjacent the side openings 57 to also assist with movement of the paddles 56. For each handle 64, the rotor 54 has an open lift assembly area 65 for a lifter assembly that includes a lifter 58 and a corresponding backstop 59 that contacts the lifter.

Each handle 64 includes a threaded section 80 that operates as a gear in response to a corresponding threaded section 82 on the lifter 58 that also operates as a gear. When the lifter 58 moves in a downward direction, the paddle 64 is moved to the horizontal position. When the lifter 58 moves in a downward direction, the paddle 64 is moved to the vertical position. Each backstop 59 is fixably attached to the rotor 54 within the open lift assembly area 65. Each backstop 59 includes a series of rollers 84 to assist with movement of the lifter 58 between the up and down positions.

Figure 10:
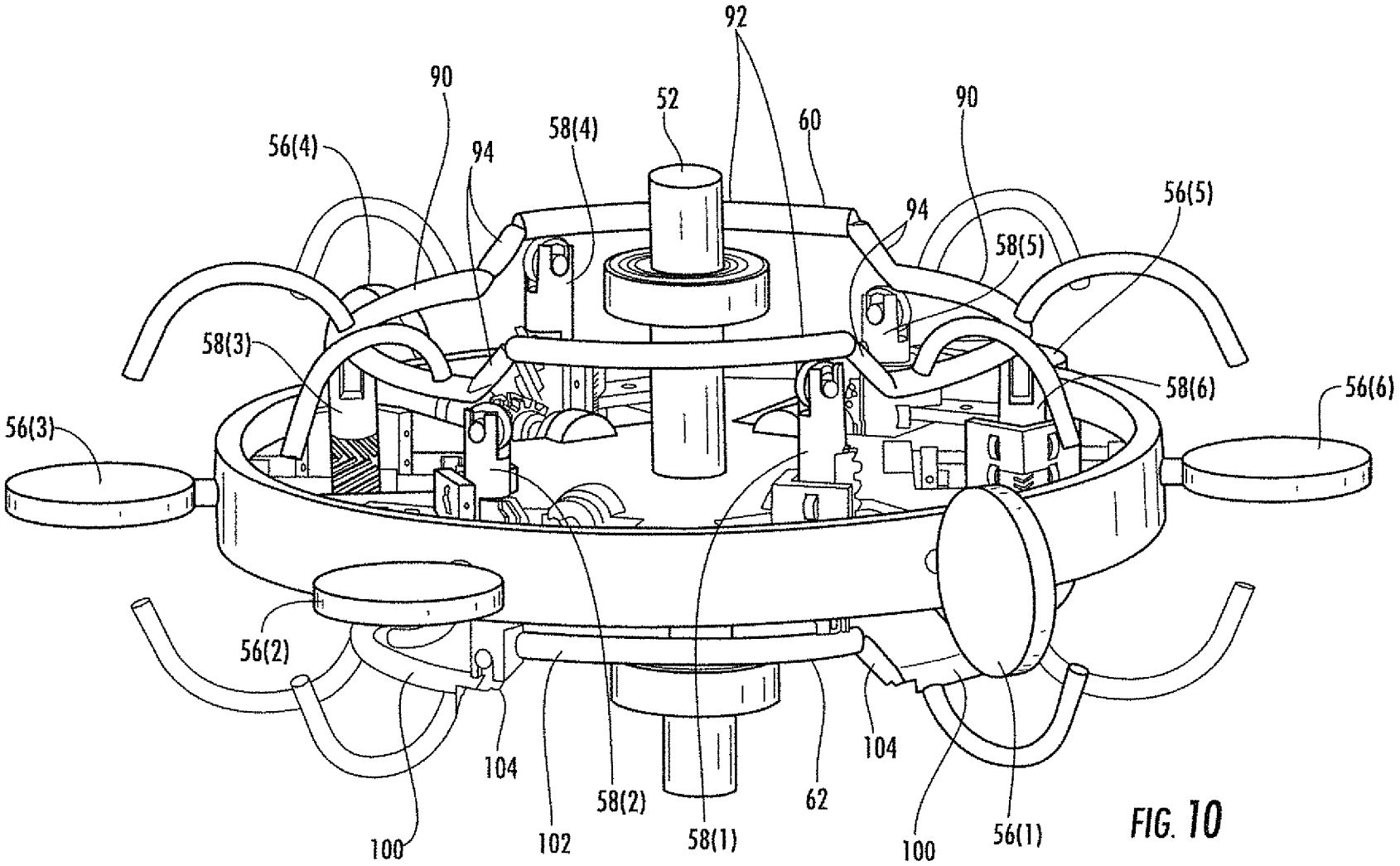
FIG. 10 is a perspective view of the rotor section of the rotary energy without the chamber section in accordance with the present invention.

The opposing ends of each lifter 58 include a roller bearing 86. The roller bearings 86 move along the upper and lower guide rails 60 and 62, as illustrated in FIG. 10 with the chamber section not being shown. However, the upper and lower guide rails 60, 62 do not rotate, and are fixably coupled to the chamber section 50.

The upper and lower rails guide rails 60, 62 include first sections 90, 100 that cause the lifters 58 to move the paddles 56 to the horizontal position, and second sections 92, 102 that cause the lifters 58 to move the paddles 56 to the vertical position. For example, lifters 58(1) and 58(4) are positioned along the first sections 92, 102 so that the paddles 56(1) and 56(4) are in the vertical position. Lifters 58(2), 58(3), 58(5) and 58(6) are positioned along the second sections 92, 102 so that the paddles 56(2), 56(3), 56(5) and 56(6) are in the horizontal position. Between the first sections 90, 100 and the second sections 92, 102 are transition sections 94, 104.

As the steam pushes the paddles 56 within the open chamber areas 76, the rotor 54 rotates. As the rotor 54 rotates, the lifters 58 move along the upper and lower guide rails 60, 62 causing the paddles 56 to move between the vertical and horizontal position.

Figure 11:
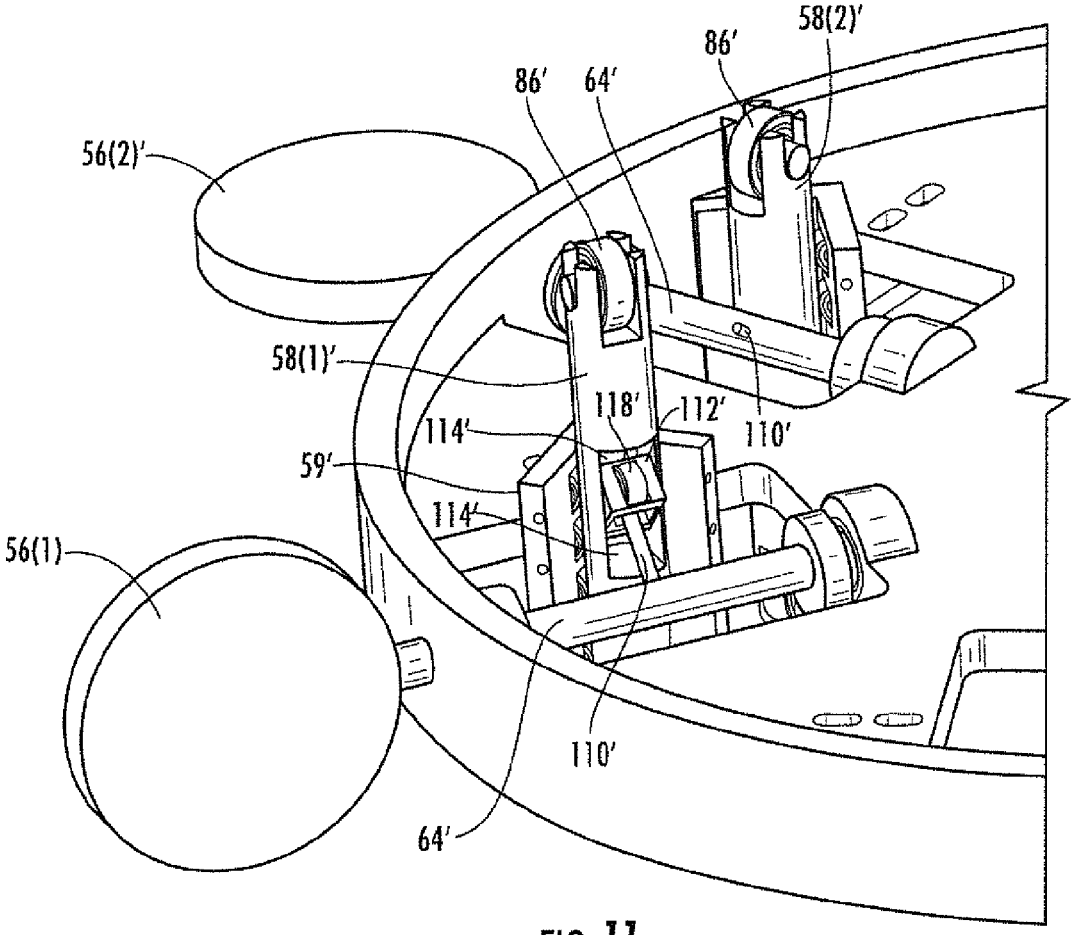
FIG. 11 is a perspective sectional view of the rotor of the rotary energy including another embodiment of the paddles and lifters in accordance with the present invention.
Figures 12A, 12B:
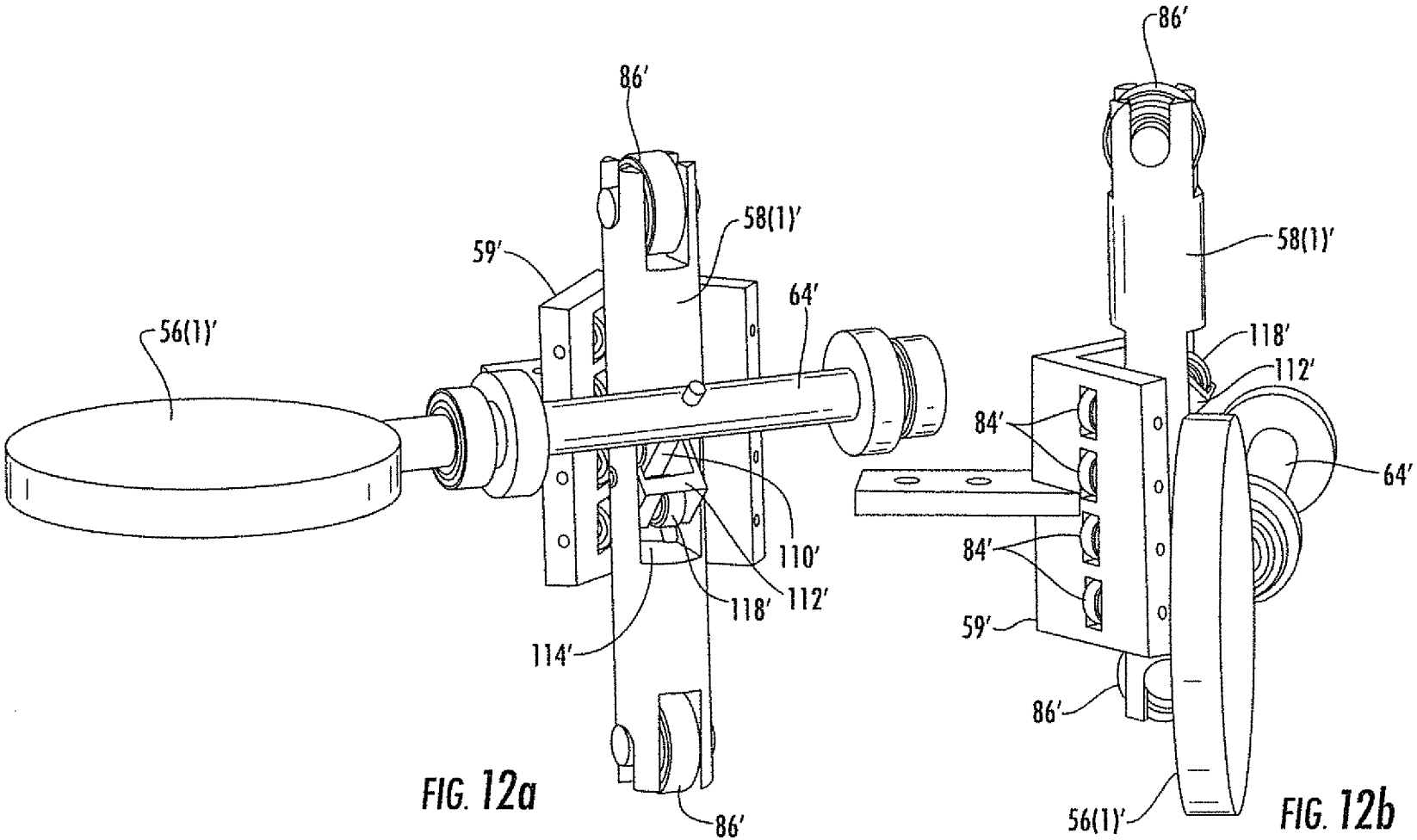
FIGS. 12*a* and 12*b* are side perspective views of a paddle and corresponding lifter illustrated in FIG. 11.

An alternative embodiment of the paddles 56' and lifters 58' will now be discussed in reference to FIGS. 11, 12*a* and 12*b*. In this embodiment, the corresponding threaded sections are replaced by a lever 110' that has one end coupled to the frame 64'. The other end of the lever 110' is coupled to a roller bearing assembly 112' that moves up and down within a recessed pocket 114' formed in the lifter 58'. The roller bearing assembly 112' includes a roller bearing 118' contacting the sidewalls of the recessed pocket 114'.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within.

That which is claimed is:

1. A rotary energy generating device comprising:
- an output shaft;
- a rotor coupled to said output shaft;
- a plurality of paddles coupled to said rotor, with each paddle being moved between vertical and horizontal positions as said rotor is rotated;
- a plurality of lifters carried by said rotor, with each paddle having a lifter coupled thereto, each lifter including a recessed pocket, and a roller bearing assembly that moves up and down in the recessed pocket of each lifter;
- each paddle comprising a handle extending outwards therefrom, and a respective lever coupled between said handle and said roller bearing assembly of each lifter; and
- a chamber housing including
  - a plurality of inlet and outlet pairs,
  - a respective open chamber area defined between each inlet and outlet pair based on a given rotation direction of said rotor, with each respective open chamber area configured to receive said plurality of paddles in the vertical position as said rotor rotates in the given rotation direction, and
  - a respective slotted chamber area defined between each outlet and inlet pair based on the given rotation direction of said rotor, with each respective slotted chamber area configured to receive said plurality of paddles in the horizontal position as said rotor rotates in the given rotation direction.

2. The rotary energy generating device according to claim 1 wherein each inlet is configured to receive a pressurized fluid to push a paddle through a respective open chamber area, and each outlet is configured to exhaust the pressurized fluid after the paddle has been pushed through a respective slotted chamber area.

3. The rotary energy generating device according to claim 1 wherein each lifter comprises a threaded section; and wherein each paddle comprises a handle extending outwards therefrom, with said handle comprising a threaded section for engaging said threaded section of a respective lifter.

4. The rotary energy generating device according to claim 1 further comprising a plurality of backstops carried by said rotor, with each lifter having a backstop associated therewith.

5. The rotary energy generating device according to claim 1 wherein each lifter comprises an upper bearing carried by an upper end thereof, and a lower bearing carried by an opposing lower end thereof; and further comprising:
- a fixed upper guide rail contacting said upper guide bearings of said plurality of lifters; and
- a fixed lower guide rail contacting said lower guide bearings of said plurality of lifters;
- with said fixed upper and lower guide rails being configured to guide said plurality of lifters for moving said plurality of paddles between the vertical and horizontal positions as said rotor is rotated.

6. The rotary energy generating device according to claim 5 wherein said fixed upper and lower guide rails are coupled to said chamber housing.

7. The rotary energy generating device according to claim 1 wherein each paddle is circular shaped, and each respective open chamber area is circular.

8. A rotary energy generating system comprising:
- a steam generator;
- a rotary energy generating device coupled to said steam generator and comprising
  - an output shaft,
  - a rotor coupled to said output shaft,
  - a plurality of lifters carried by said rotor,
  - a plurality of backstops carried by said rotor, with each lifter having a backstop associated therewith;
  - a plurality of paddles coupled to said rotor, with each paddle having a lifter coupled thereto and being moved between vertical and horizontal positions as said rotor is rotated, and
  - a chamber housing including
    - a plurality of inlet and outlet pairs, with the plurality of inlet pairs configured to receive pressurized steam from said steam generator,
    - a respective open chamber area defined between each inlet and outlet pair based on a given rotation direction of said rotor, with each respective open chamber area configured to receive said plurality of paddles in the vertical position as said rotor rotates in the given rotation direction, and
    - a respective slotted chamber area defined between each outlet and inlet pair based on the given rotation direction of said rotor, with each respective slotted chamber area configured to receive said plurality of paddles in the horizontal position as said rotor rotates in the given rotation direction; and an electrical generator coupled to said output shaft of said rotary energy generating device.

9. The rotary energy generating system according to claim 8 wherein each inlet is configured to push a paddle through a respective open chamber area based on the pressurized steam, and each outlet is configured to exhaust the pressurized steam after the paddle has been pushed through a respective slotted chamber area.

10. The rotary energy generating system according to claim 8 wherein each lifter comprises a threaded section; and wherein each paddle comprises a handle extending outwards therefrom, with said handle comprising a threaded section for engaging said threaded section of a respective lifter.

11. The rotary energy generating system according to claim 8 wherein each lifter includes a recessed pocket, and further comprising a roller bearing assembly that moves up and down in the recessed pocket of each lifter; wherein each paddle comprises a handle extending outwards therefrom, and further comprising a respective lever coupled between said handle and said roller bearing assembly of each lifter.

12. The rotary energy generating system according to claim 8 wherein each lifter comprises an upper bearing carried by an upper end thereof, and a lower bearing carried by an opposing lower end thereof; and further comprising:

a fixed upper guide rail contacting said upper guide bearings of said plurality of lifters; and a fixed lower guide rail contacting said lower guide bearings of said plurality of lifters;

with said fixed upper and lower guide rails being configured to guide said plurality of lifters for moving said plurality of paddles between the vertical and horizontal positions as said rotor is rotated.

13. The rotary energy generating system according to claim 12 wherein said fixed upper and lower guide rails are coupled to said chamber housing.

14. The rotary energy generating system according to claim 8 wherein each paddle is circular shaped, and each respective open chamber area is circular.

15. A rotary energy generating device comprising:

an output shaft;

a rotor coupled to said output shaft;

a plurality of paddles coupled to said rotor, with each paddle being moved between vertical and horizontal positions as said rotor is rotated;

a plurality of lifters carried by said rotor, with each paddle having a lifter coupled thereto;

a plurality of backstops carried by said rotor, with each lifter having a backstop associated therewith; and a chamber housing including a plurality of inlet and outlet pairs, a respective open chamber area defined between each inlet and outlet pair based on a given rotation direction of said rotor, with each respective open chamber area configured to receive said plurality of paddles in the vertical position as said rotor rotates in the given rotation direction, and a respective slotted chamber area defined between each outlet and inlet pair based on the given rotation direction of said rotor, with each respective slotted chamber area configured to receive said plurality of paddles in the horizontal position as said rotor rotates in the given rotation direction.

16. The rotary energy generating device according to claim 15 wherein each inlet is configured to receive a pressurized fluid to push a paddle through a respective open chamber area, and each outlet is configured to exhaust the pressurized fluid after the paddle has been pushed through a respective slotted chamber area.

17. The rotary energy generating device according to claim 15 wherein each lifter comprises a threaded section; and wherein each paddle comprises a handle extending outwards therefrom, with said handle comprising a threaded section for engaging said threaded section of a respective lifter.

18. The rotary energy generating device according to claim 15 further comprising a plurality of backstops carried by said rotor, with each lifter having a backstop associated therewith.

19. The rotary energy generating device according to claim 15 wherein each lifter comprises an upper bearing carried by an upper end thereof, and a lower bearing carried by an opposing lower end thereof; and further comprising:

a fixed upper guide rail contacting said upper guide bearings of said plurality of lifters; and a fixed lower guide rail contacting said lower guide bearings of said plurality of lifters;

with said fixed upper and lower guide rails being configured to guide said plurality of lifters for moving said plurality of paddles between the vertical and horizontal positions as said rotor is rotated.

* * * * *